US011976399B2

(12) United States Patent
Tanaka

(10) Patent No.: US 11,976,399 B2
(45) Date of Patent: May 7, 2024

(54) NEEDLE THREADER AND NEEDLE THREADING MECHANISM

(71) Applicant: Clover Mfg. Co., Ltd., Osaka (JP)

(72) Inventor: Atsushi Tanaka, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 73 days.

(21) Appl. No.: 17/968,529

(22) Filed: Oct. 18, 2022

(65) Prior Publication Data

US 2023/0151522 A1 May 18, 2023

(30) Foreign Application Priority Data

Nov. 12, 2021 (JP) ..... 2021-184948

(51) Int. Cl.
*D05B 87/02* (2006.01)

(52) U.S. Cl.
CPC ..... *D05B 87/02* (2013.01)

(58) Field of Classification Search
CPC ..... D05B 87/00; D05B 87/02; D05B 87/04
USPC ..... 223/99; 112/224, 225
See application file for complete search history.

(56) References Cited

U.S. PATENT DOCUMENTS 2,338,159 A * 1/1944 Appleton ..... D05B 87/00 223/99
2,490,883 A * 12/1949 Pinkham ..... D05B 87/00 223/99
2,777,623 A * 1/1957 Balzer ..... D05B 87/00 223/99
4,911,341 A * 3/1990 Davis ..... D05B 87/02 223/99
6,045,016 A * 4/2000 Okada ..... D05B 87/00 112/225
8,020,735 B2 * 9/2011 Chang ..... D05B 87/02 223/99
9,085,841 B2 * 7/2015 Noguchi ..... D05B 87/02
2010/0206206 A1 * 8/2010 Chang ..... D05B 87/02 112/225

FOREIGN PATENT DOCUMENTS

EP 1388602 A2 * 2/2004 ..... D05B 87/00
JP 200051561 A * 2/2000
JP 3741673 B2 11/2005
JP 2009183375 A * 8/2009
WO WO-2009113529 A1 * 9/2009 ..... D05B 85/00

* cited by examiner

*Primary Examiner* — Danny Worrell
(74) *Attorney, Agent, or Firm* — HSML P.C.

(57) ABSTRACT

A needle threader includes: a needle holding part for holding a needle having a needle eye; a threading member movable between a retracted position separated from the needle holding part and an advanced position for inserting a thread loop through the needle eye by entering the needle eye; an actuator mechanism including an operation element, to move the threading member to the retracted position in a first state (not operating) and move to the advanced position in a second state (operating); and a thread pressing mechanism for pressing the thread loop inserted through the needle eye by the threading member. The thread pressing mechanism includes a pressure receiving part, a pressing member, and a biasing member. Switching the operation element from the second state to the first state, the pressing member can press the thread loop against the pressure receiving part.

7 Claims, 15 Drawing Sheets

NEEDLE THREADER AND NEEDLE THREADING MECHANISM

FIELD

The present disclosure relates to a needle threader and a needle threading mechanism for inserting a thread through the eye of a needle, such as a sewing needle.

BACKGROUND

A conventional needle threader is disclosed in JP-B-3741673, for example. The needle threader includes a needle holding part, a pusher (a threading member) and an actuator mechanism. When a needle is set in the needle holding part and an operation lever of the actuator mechanism is operated, the tip of the pusher is advanced through the eye of the needle and pushes thread into the needle eye to form a loop (see FIG. 12 of JP-B-3741673). When the operation lever is moved back to its original position, the pusher retracts to a position away from the needle eye. Then, the needle is pulled out from the needle holding part, with the thread passing through the needle eye twice to form a loop. To complete the threading, the loop of thread needs to be pulled until a thread end comes out through the needle eye. Then, the needle is ready for sewing, with the thread running straight through the needle eye.

The loop of thread formed by the conventional needle threader extends as much as a few millimeters from the needle eye. Holding such a loop of thread with fingers to pull a thread end through the needle eye can be fiddly work. Moreover, the loop of thread may accidentally slip out of the needle during the work. If this happens, all the work needs to be repeated again, starting from setting the needle on the needle holding part, which is troublesome.

TECHNICAL REFERENCE

Patent Document 1: JP-B-3741673

SUMMARY

The present disclosure has been conceived in view of the circumstances described above. An object of the present disclosure is to provide a needle threader configured to improve usability.

To handle the above issues, the present disclosure utilizes the following technical means.

A needle threader according to a first aspect of the present disclosure includes: a needle holding part for holding a needle having a needle eye; a threading member reciprocally movable between a retracted position separated from the needle holding part and an advanced position for inserting a loop of thread through the needle eye by the threading member entering the needle eye; an actuator mechanism including an operation element and being configured to move the threading member to the retracted position when the operation element is in a first state to not operate the operation element and move to the advanced position when the operation element is in a second state to operate the operation element; and a thread pressing mechanism for pressing the loop of thread that is inserted through the needle eye by the threading member. The thread pressing mechanism includes a pressure receiving part, a pressing member that is reciprocally movable between a first position on or near the pressure receiving part and a second position separated from the pressure receiving part, and a biasing member that urges the pressing member toward the first position, and when the operation element is in the second state, the pressing member is moved to the second position, and when the operation element is switched from the second state to the first state, the pressing member is capable of pressing the loop of thread against the pressure receiving part.

In a preferred embodiment, the needle holding part includes a needle receiving hole having a needle supporting bottom surface, the needle receiving hole extending in a first direction that is along a longitudinal direction of the needle held by the needle holding part, the needle supporting bottom surface being offset in a first sense of the first direction, the threading member moves to the advanced position by entering the needle eye in a first sense of a second direction perpendicular to the first direction, the pressing member includes a pressure applying tip for contacting the loop of thread, and the pressure applying tip extends in a third direction perpendicular to the first direction and the second direction.

In a preferred embodiment, the pressure receiving part is disposed to face the pressure applying tip as viewed in the second direction.

In a preferred embodiment, the pressing member has a first sloped portion that is connected to a center of the pressure applying tip in the third direction and inclined in the first sense of the first direction as it extends in the first sense of the second direction.

In a preferred embodiment, the needle threader further includes a first housing member and a second housing member supporting the actuator mechanism and being respectively offset in a first sense and a second sense of the third direction. The first housing member has a first abutting surface facing in the second sense of the third direction, and the second housing member has a second abutting surface facing in the first sense of the third direction and in contact with the first abutting surface, the first housing member includes a first protruding wall that protrudes from the first abutting surface in the second sense of the third direction, and the first protruding wall includes the pressure receiving part.

In a needle threader according to a second aspect of the present disclosure, the needle receiving hole includes a first section offset in the first sense of the first direction, a second section separated from the first section in a second sense of the first direction, and a third section located between the first section and the first section, the needle holding part includes a movable member for pushing the needle in the first sense of the second direction, the third section is composed of the movable member, the needle holding part has a first slit, a second slit and a third slit that are respectively opened in the first section, the second section and the third section toward a side of each section in a second sense of the second direction, the second slit extends in the first direction as viewed in the second direction, the third slit extends in the first direction as viewed in the second direction and is connected to the first slit and the second slit, and the first slit includes a curved portion that is gently curved in the third direction from the first direction as viewed in the second direction.

A needle threading mechanism that includes: a needle receiving hole having a needle supporting bottom surface, the needle receiving hole extending in a first direction that is along a longitudinal direction of a needle held in the needle receiving hole, the needle supporting bottom surface being offset in a first sense of the first direction; and a threading member that can enter a needle eye of the needle held in the needle receiving hole, the needle threading mechanism being capable of inserting a loop of thread through the needle eye by the threading member entering the needle eye. The needle threading mechanism includes: a guide mechanism for guiding the needle into the needle receiving hole, wherein the needle receiving hole is formed with a slit that extends substantially across an entire length of the needle receiving hole in the first direction and that includes a curved portion gently curved from the first direction; and a thread pressing mechanism including a pressure receiving part and a pressing member that is reciprocally movable between a first position on or near the pressure receiving part and a second position separated from the pressure receiving part, wherein the pressing member is moved to the second position when the threading member enters the needle eye, and the pressing member is capable of pressing the loop of thread inserted through the needle eye against the pressure receiving part when the threading member retracts to a position away from the needle eye.

Other features and advantages of the needle threader according to the present disclosure will be more apparent from the detailed description given below with reference to the accompanying drawings.

DRAWINGS

Figure 1:
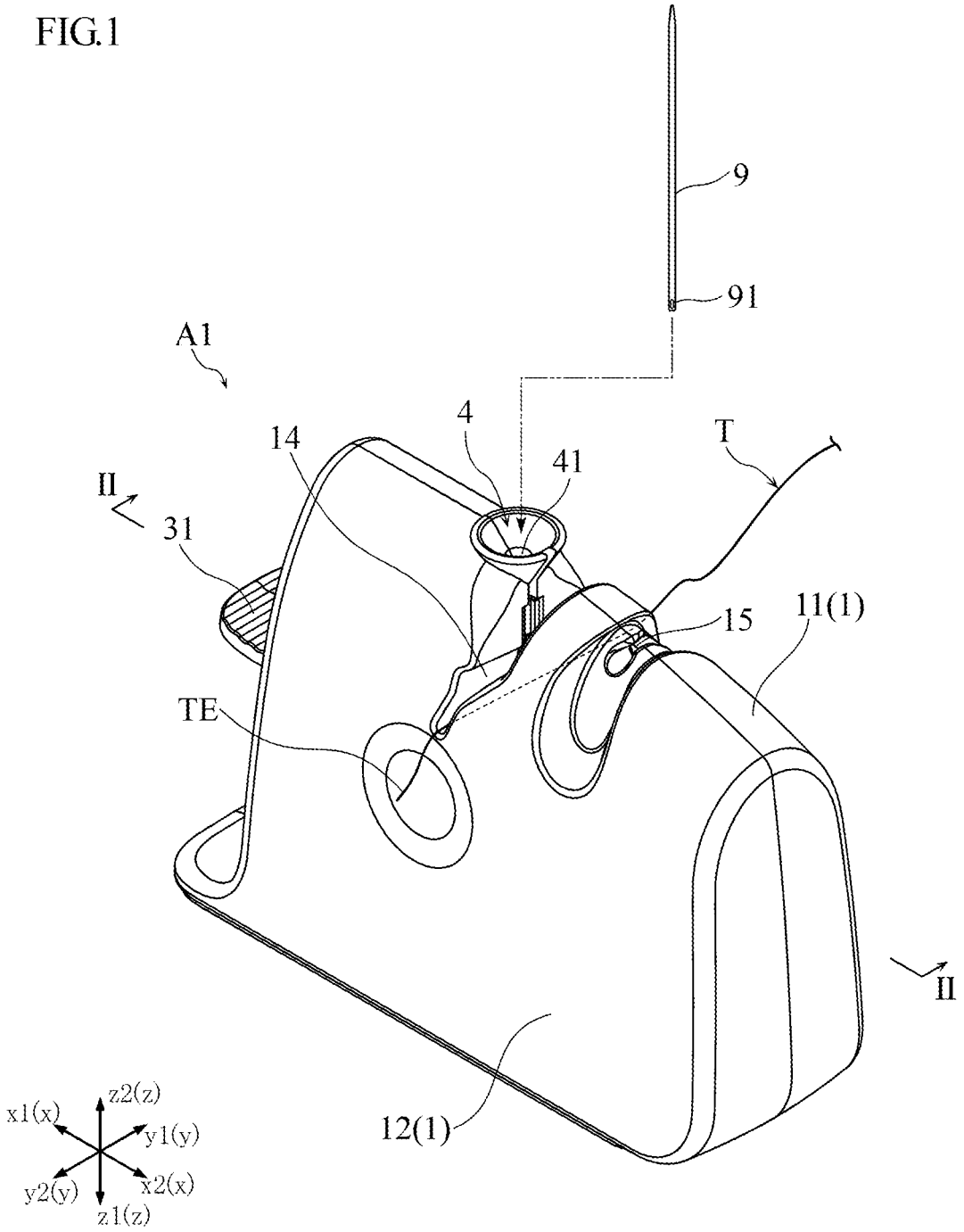
FIG. 1 is a perspective view showing a needle threader according to an embodiment.
Figure 2:
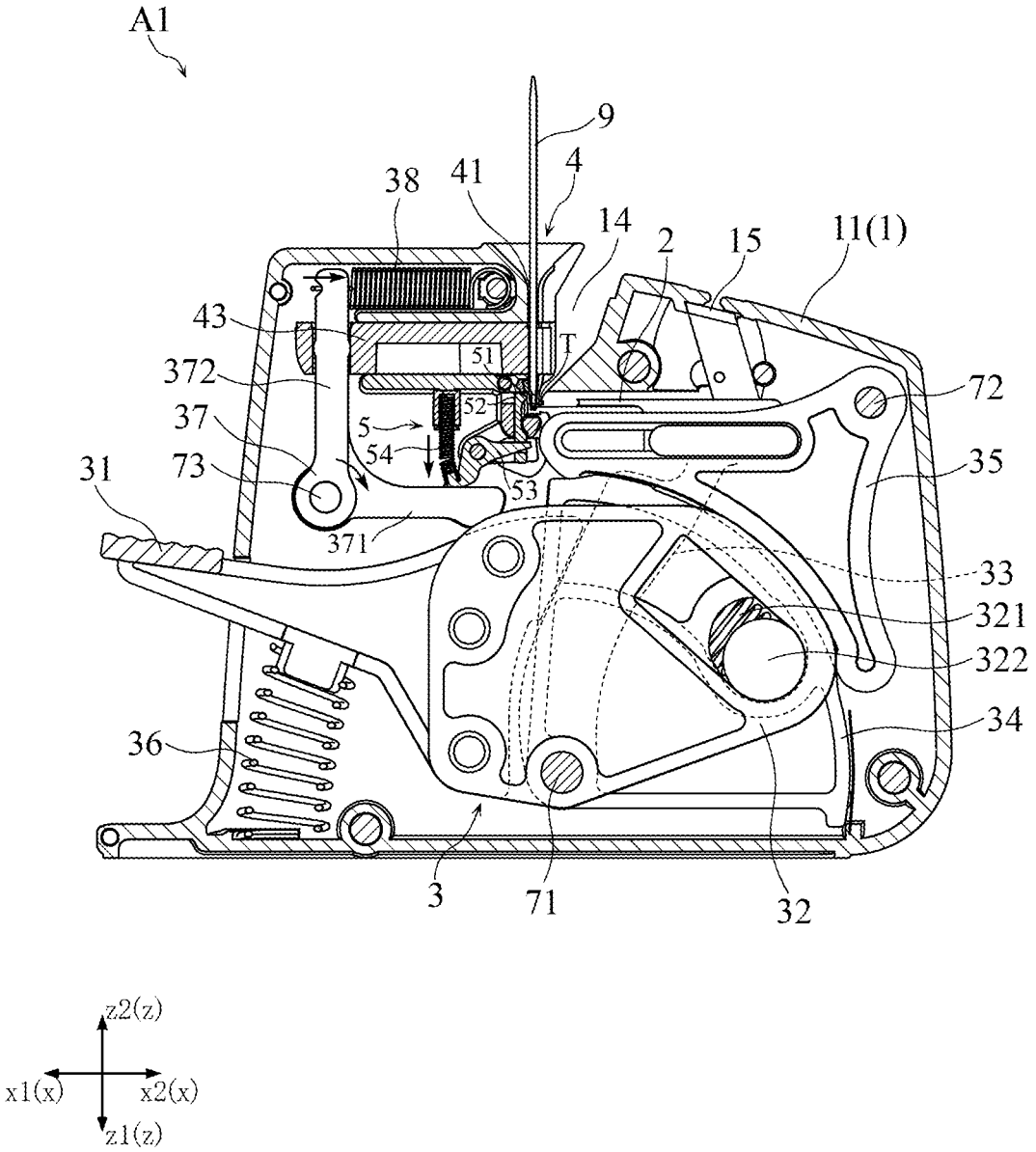
FIG. 2 is a sectional view taken along line II-II of FIG. 1.
Figure 11:
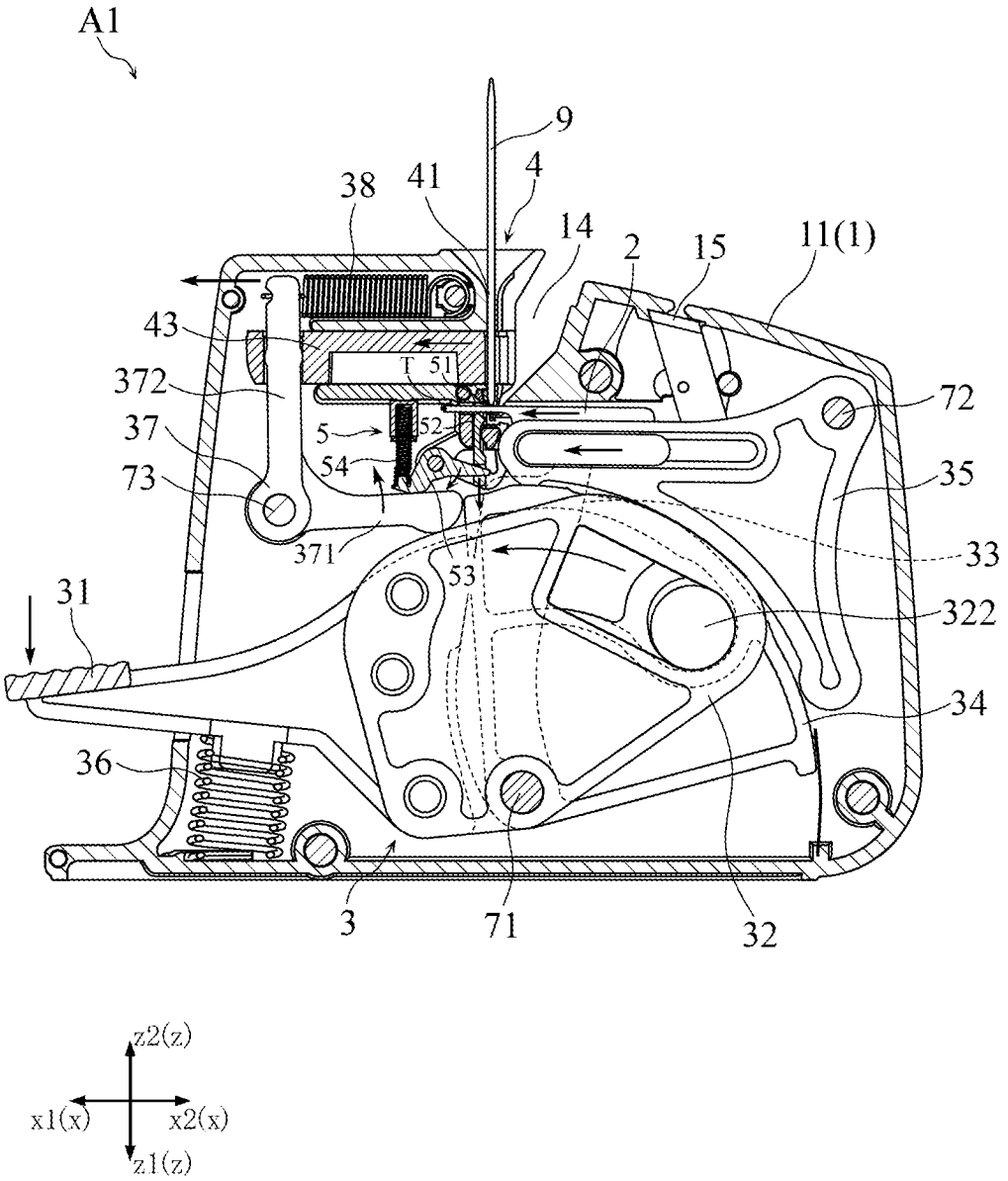

FIG. 11 a sectional view similar to FIG. 2 and showing an operation state of the needle threader of FIG. 1.

Figure 12:
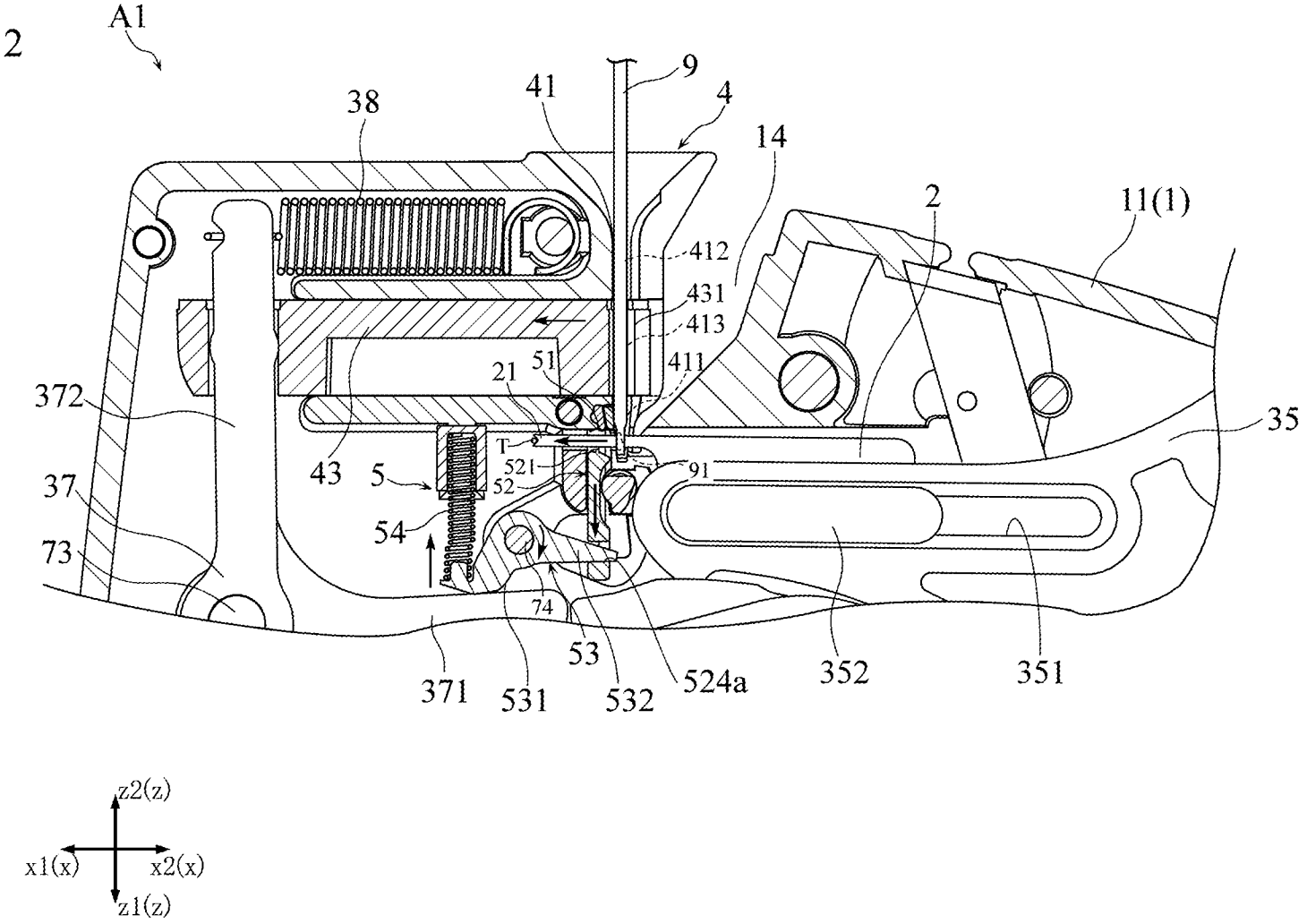

FIG. 12 is an enlarged view showing a portion of FIG. 11.

Figure 13:
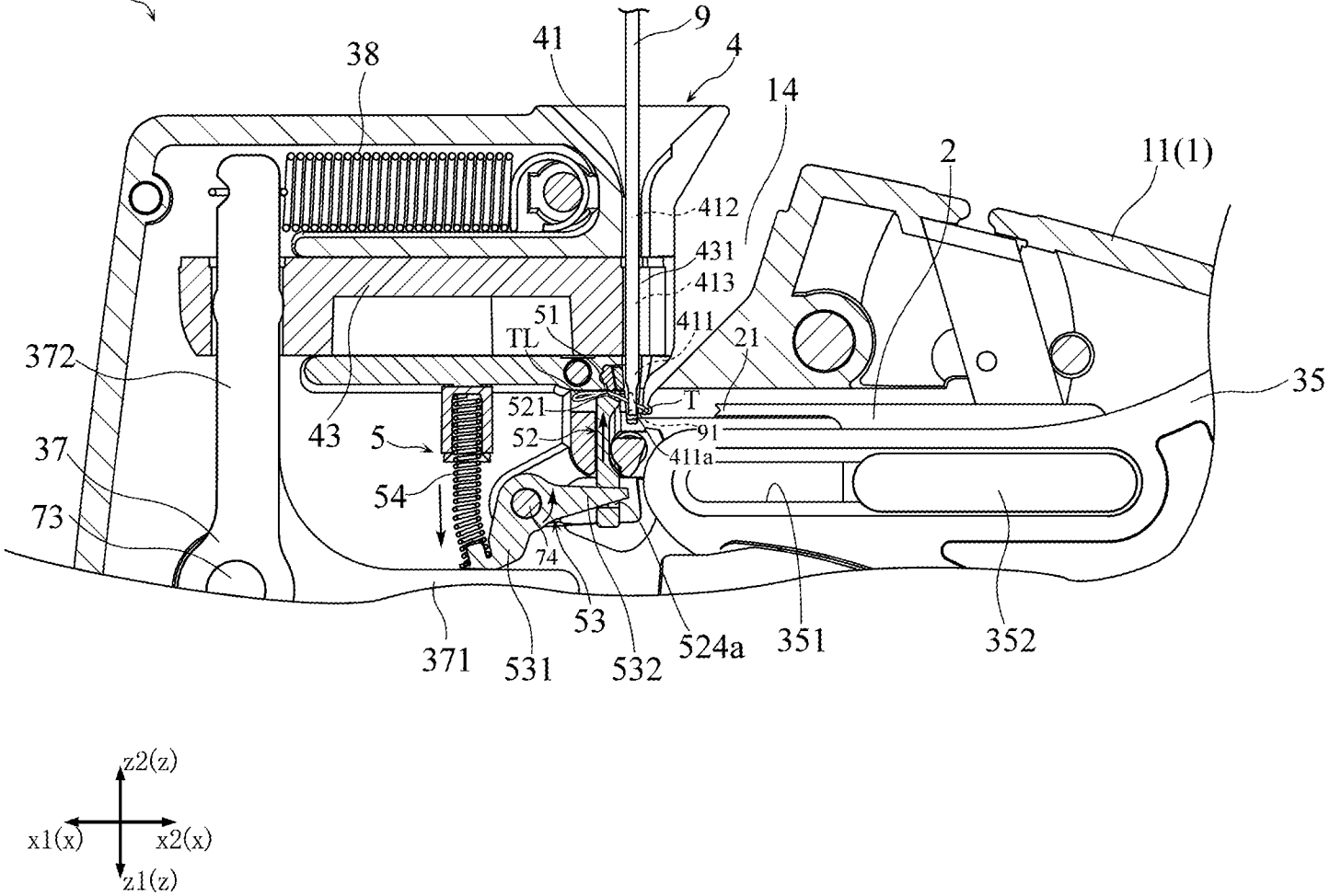

FIG. 13 a sectional view similar to FIG. 12 and showing an operation state of the needle threader of FIG. 1.

Figure 9:
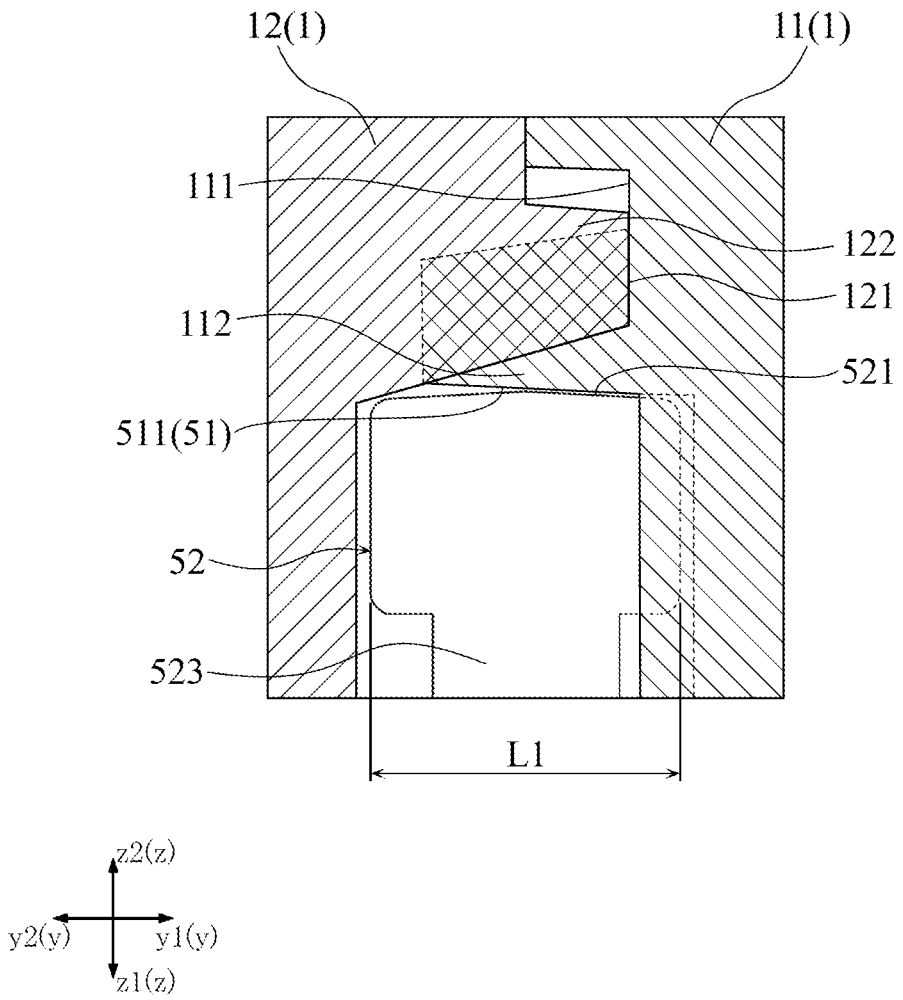
FIG. 9 is a schematic view showing the relative positions of a first protruding wall and the pressing member as viewed in the x direction.
Figure 14:
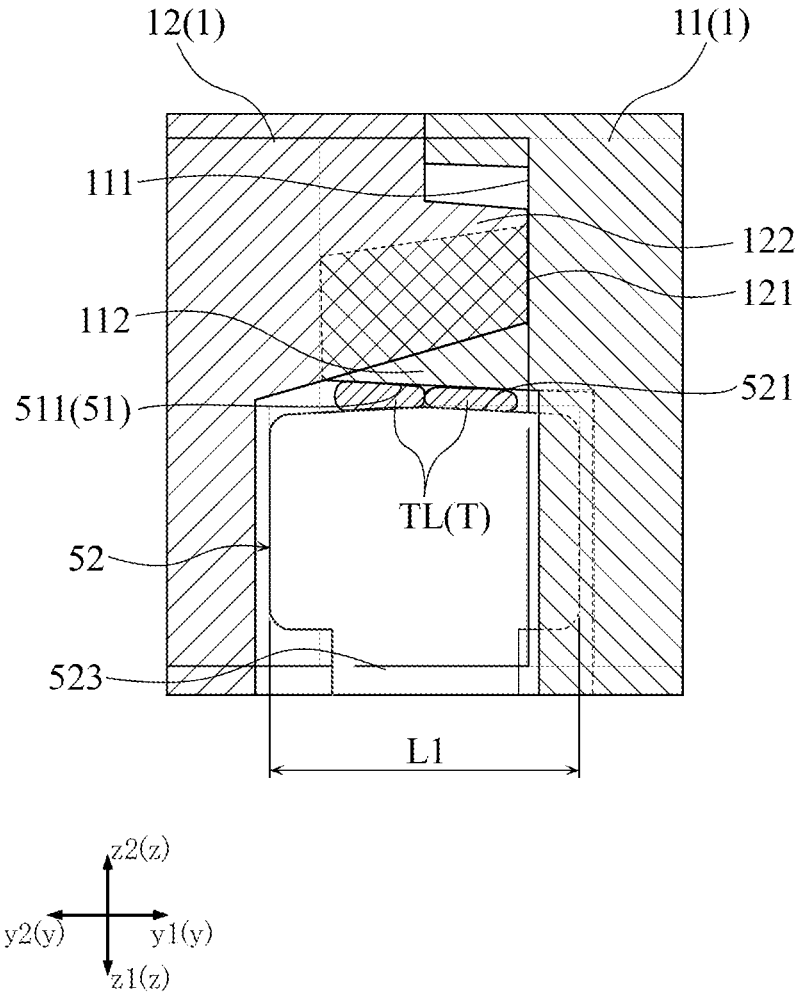

FIG. 14 is a schematic view similar to FIG. 9 and illustrating the operation shown in FIG. 13.

Figure 15:
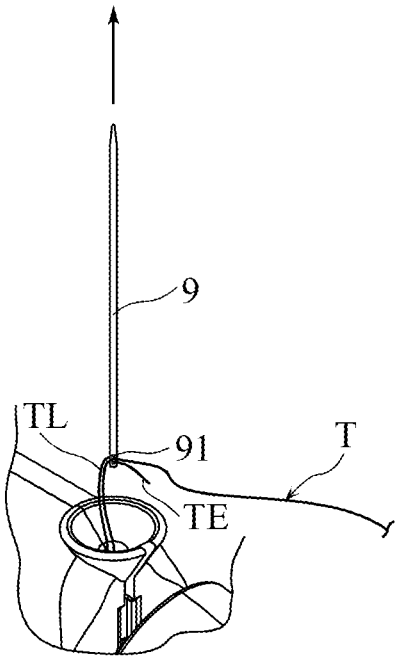

FIG. 15 is a perspective view showing a needle being pulled up.

Figure 16:
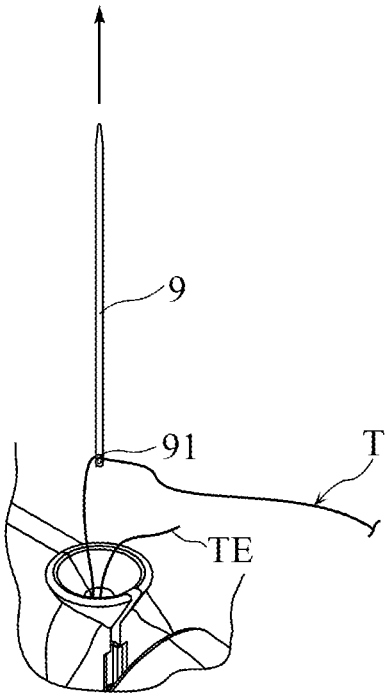

FIG. 16 is a perspective view showing the needle being pulled up and completely threaded.

EMBODIMENTS

Embodiments of a needle threader will be described below with reference to the accompanying drawings.

FIGS. 1 to 4 show a needle threader according to one embodiment. The needle threader A1 includes a housing 1, a threading member 2, an actuator mechanism 3, a needle holding part 4 and a thread pressing mechanism 5.

Figure 3:
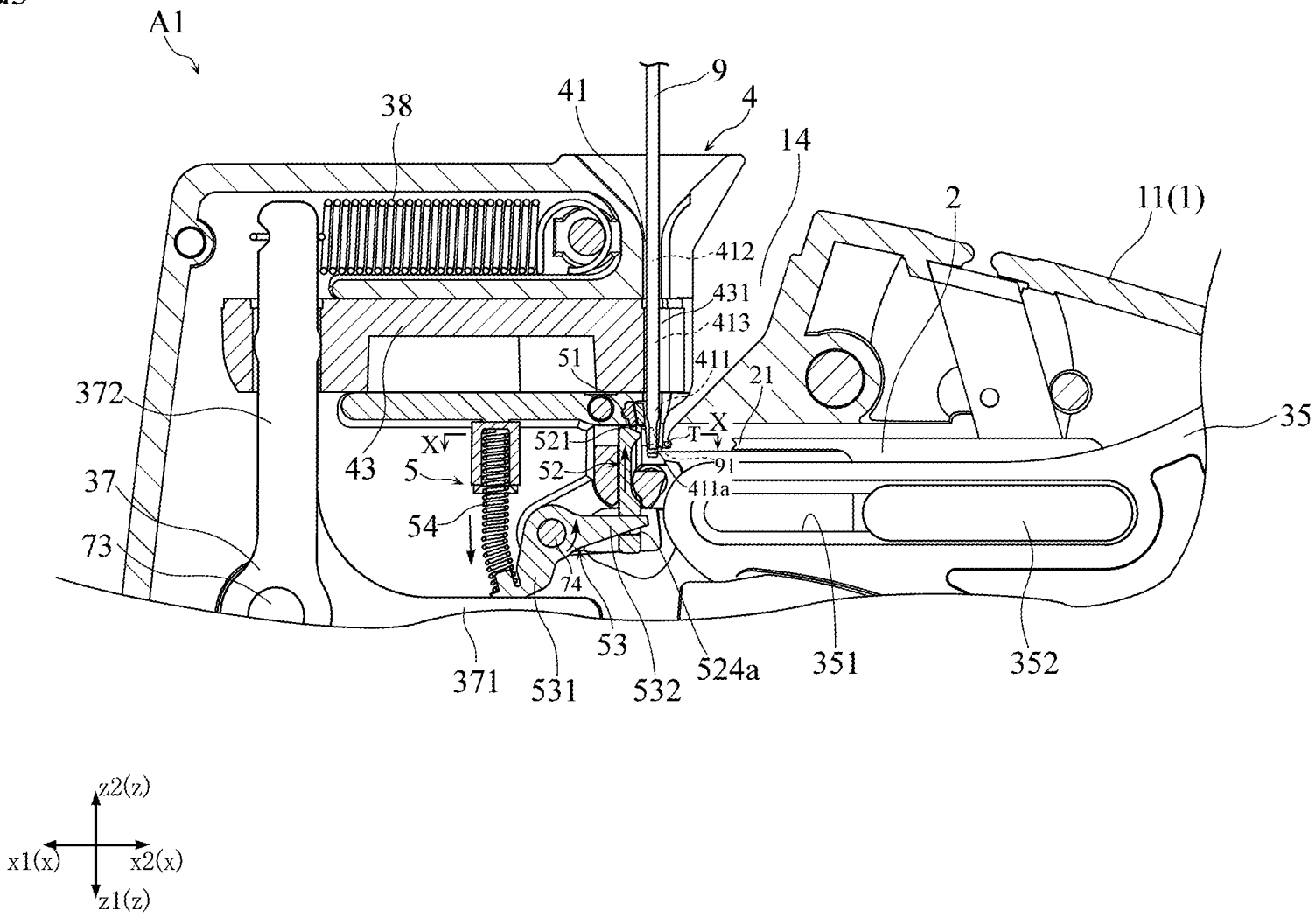
FIG. 3 is an enlarged view showing a portion of FIG. 2.
Figure 4:
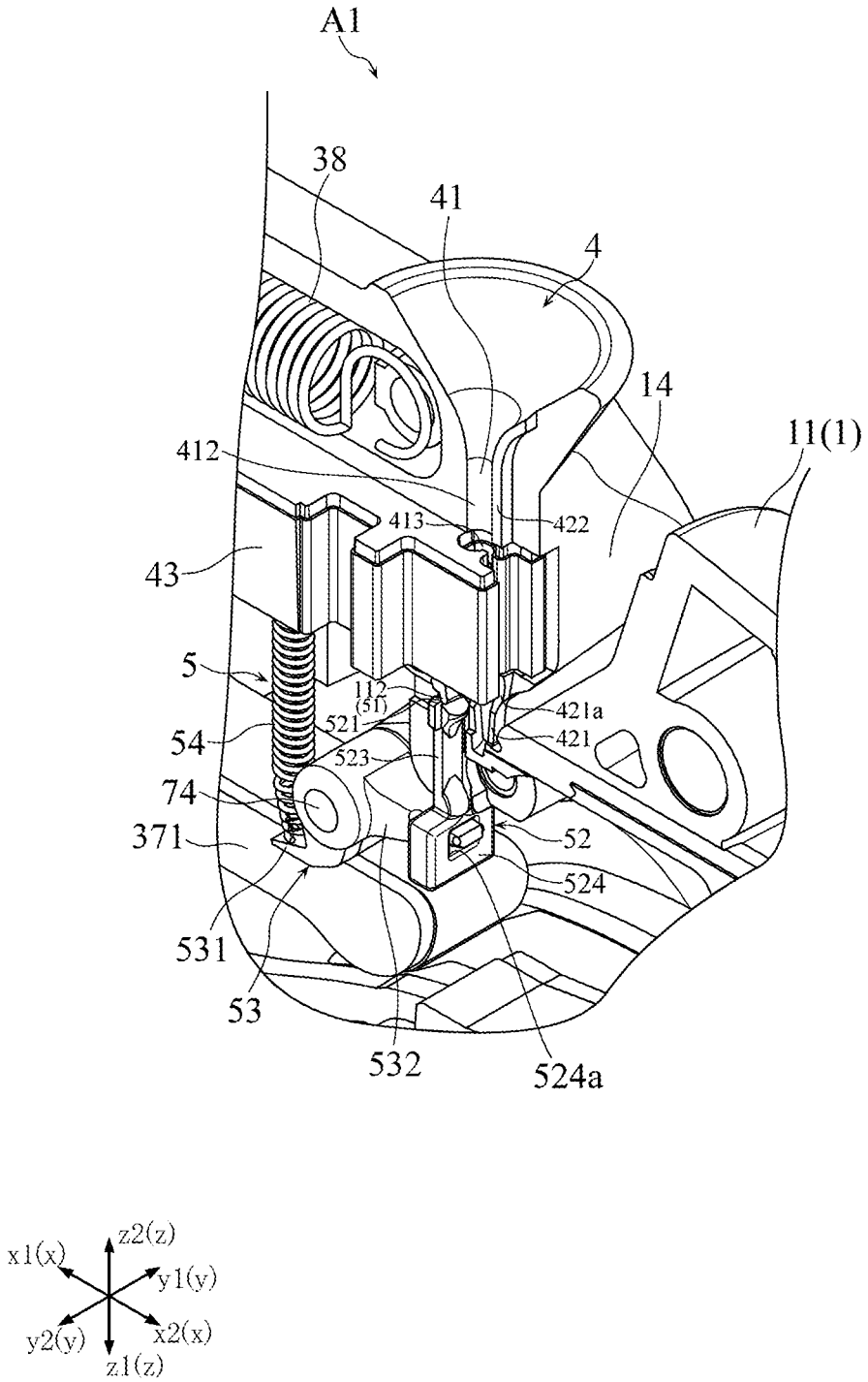
FIG. 4 is a perspective view showing the internal structure of the needle threader of FIG. 1 (omitting a second housing member).

FIG. 1 is a perspective view showing the needle threader A1. FIG. 2 is a sectional view taken along line II-II of FIG. 1. FIG. 3 is an enlarged view showing a portion of FIG. 2. FIG. 4 is a perspective view showing the internal structure of the needle threader A1. For convenience, the upward and downward directions are defined with reference to the orientation shown in FIG. 1.

The housing 1 supports the threading member 2, the actuator mechanism 3, the needle holding part 4 and the thread pressing mechanism 5. In one example, the housing 1 may be formed by molding synthetic resin. The housing 1 includes a first housing member 11 and a second housing member 12. The first housing member 11 is offset in a y1 direction (a first sense of a third direction), and the second housing member 12 is offset in a y2 direction (a second sense of the third direction). The first housing member 11 and the second housing member 12 together define the interior space of the housing 1. The interior space accommodates the threading member 2, the actuator mechanism 3, the needle holding part 4 and the thread pressing mechanism 5. An upper part of the housing 1 is provided with a recess 14 and a cutting blade 15 for cutting thread T. To use the needle threader A1, a length of thread T is hooked over the bottom of the recess 14. As later described, the first housing member 11 and the second housing member 12 (the housing 1) form portions of the needle holding part 4 and the thread pressing mechanism 5.

The needle holding part 4 is provided for holding a needle 9 upright and includes a needle receiving hole 41 and a movable member 43. The needle receiving hole 41 is open in the upper surface of the housing 1 and extends in a vertical direction i.e., a z direction (a first direction). The needle 9 is inserted into the needle receiving hole 41 with its head (the end where the needle eye 91 is formed) pointing downward. The needle 9 received in the needle receiving hole 41 has a longitudinal direction along the z direction. The internal diameter of the needle receiving hole 41 is large enough for receiving multiple types of needles commonly used for sewing.

The needle receiving hole 41 has a needle supporting bottom surface 411*a* at the bottom. The needle supporting bottom surface 411*a* is for supporting the head of the needle 9 and shaped as a concave surface. Generally, a needle is relatively flat around its head where an eye for threading is formed. The needle supporting bottom surface 411*a* is a concave surface shaped to closely receive such a flat head of a needle in a proper orientation. That is, when the head of the needle 9 is placed in contact with the needle supporting bottom surface 411*a*, the needle 9 is properly oriented to have the needle eye 91 facing straight the threading member 2. Details of the needle receiving hole 41 will be described later.

The movable member 43 is provided for positioning the needle 9 in place, by pressing the needle 9 against an inner wall of the needle receiving hole 41. The movable member 43 may be made of synthetic resin, for example, and forms a portion of the needle receiving hole 41. The movable member 43 reciprocates in a horizontal direction i.e., an x direction (a second direction) when an operation lever 31 is operated, as will be described later. Details of the movable member 43 will be described later.

The threading member 2 is provided for inserting the thread T through the needle eye 91 of the needle 9 and may be formed by stamping a thin metal plate into a prescribed shape. An end portion of the threading member 2 in an x1 direction (a first sense of the second direction) has a narrow elongated shape so that the end portion can pass through the needle eye 91 of the needle 9. The threading member 2 is formed with a thread-engaging portion 21 at the tip of the end portion. The thread-engaging portion 21 is concavely recessed for preventing the thread T from easily slipping out when the threading member 2 pushes the thread T.

The actuator mechanism 3 is responsible for overall actuations of various cooperative parts, including reciprocation of the threading member 2. The actuator mechanism 3 includes the operation lever 31, an actuator plate 32, a resilient member 321, a shaft 322, a swing arm 33, a cam plate 34, a guide 35, a resilient member 36, an actuating member 37 and a resilient member 38. The operation lever 31 serves as an operation element for actuating the actuator mechanism 3 and protrudes in the x1 direction from the housing 1.

The actuator plate 32 is secured to the operation lever 31, enabling the actuator plate 32 and the operation lever 31 to integrally rotate about a shaft 71. The guide 35 is provided for guiding the threading member 2 and has a slot 351 extending linearly in the x direction and a slider 352. The threading member 2 is attached to the guide 35 to be reciprocally movable along the slot 351. The swing arm 33 is provided for reciprocally moving the threading member 2 and is pivotable on the shaft 71. Although not illustrated in detail, the swing arm 33 has a top portion configured to push the slider 352 of the guide 35. By the swing arm 33 pushing the slider 352, the threading member 2 moves back and force along the slot 351. The resilient member 321 works as a cushion between the operation of the operation lever 31 and the pivotal movement of the swing arm 33. The resilient member 321, which may be a compression coil spring, is interposed between the swing arm 33 and the shaft 322. The shaft 322 is substantially cylindrical and moves in an arcuate path about the shaft 71 in response to the operation of the operation lever 31. The guide 35 is pivotable on a shaft 72. The moving direction of the threading member 2 is changed by the pivotal movement of the guide 35. The cam plate 34 is a substantially fan-shaped plate pivotally mounted on the shaft 71. Although not illustrated in detail, the cam plate 34 has a peripheral surface that serves as a cum surface for pivoting the guide 35. As shown in FIGS. 11 and 12, when the operation lever 31 is operated, the guide 35 is inclined such that the end of the slot 351 in the x1 direction is shifted slightly upward i.e., in a z2 direction (a second sense of the first direction).

The resilient member 36 provides the resilient force tending to urge the operation lever 31 upward (in the z2 direction). The resilient member 36, which maybe a compression coil spring, is interposed between the bottom wall of the housing 1 and the lower portion of the operation lever 31. FIGS. 2 and 3 show a state where the operation lever 31 is not operated (a first state). When the operation lever 31 is not operated, the threading member 2 is in a retracted position away from the needle holding part 4 in an x2 direction (a second sense of the second direction). FIGS. 11 and 12 show a state where the operation lever 31 is operated (a second state) by pressing the operation lever 31 down against the resilient force of the resilient member 36. When the operation lever 31 is operated, the threading member 2 (the thread-engaging portion 21) moves to an advanced position by passing through the needle eye 91 in the x1 direction. When the threading member 2 (the thread-engaging portion 21) enters the needle eye 91, the thread T is pushed into the needle eye 91 and forms a loop passing through the needle eye 91.

When the operation lever 31 is released by the user, the operation lever 31 is moved upward by the resilient force of the resilient member 36 and the operation state switches back to the first state. At this time, the relevant parts of the actuator mechanism 3 move back to their original positions (as shown in FIGS. 2 and 3), and the threading member 2 moves back to the retracted position.

The actuating member 37 operatively couples the operation lever 31, the movable member 43 and the thread pressing mechanism 5. The actuating member 37 has arms 371 and 372 and is pivotable on a shaft 73. The arm 372 is inserted through a through hole formed at one end of the movable member 43. The arm 372 is normally urged in the x2 direction by the resilient member 38 (such as an extension coil spring). This produces a torque urging the actuating member 37 to rotate clockwise as viewed in FIG. 2, so that the arm 371 is pressed against the upper surface of the operation lever 31. Although not illustrated in detail, the upper surface of the operation lever 31 is configured as a cam surface. As shown in FIG. 11, this cam surface comes to push the arm 371 when the operation lever 31 is pressed downward. As a result, the arm 371 is raised in the z2 direction to move the arm 372 in the x1 direction and consequently move the movable member 43 in the x1 direction.

When the movable member 43 is moved in the x1 direction, the needle 9 is pushed against the inner wall of the needle receiving hole 41 as shown in FIG. 12. The movable member 43 is guided by the housing 1 to reciprocate in the x direction and is configured to prevent making excessively large strokes.

Figure 6:
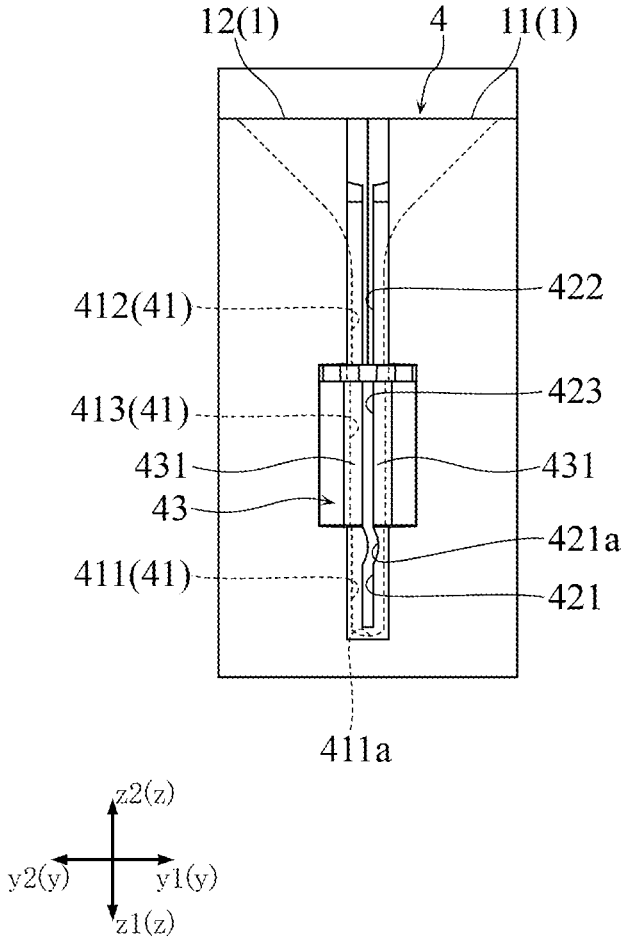
FIG. 6 is a schematic view of a first slit, a second slit and a third slit as viewed in an x direction.

In the present embodiment, the needle receiving hole 41 is formed partly in the housing 1 and partly in the movable member 43. As shown in FIGS. 3 and 6, the needle receiving hole 41 has a first section 411, a second section 412 and a third section 413. FIG. 6 is a schematic view, as viewed in the x1 direction from the recess 14 of the housing 1. The first section 411 is located on the lower portion (in a z1 direction, i.e., a first sense of the first direction) and includes the needle supporting bottom surface 411*a*. The second section 412 is located on the upper portion (in the z2 direction) of the first section 411. The third section 413 is located between the first section 411 and the second section 412 and included in the movable member 43.

In the present embodiment, the needle holding part 4 has a first slit 421, a second slit 422 and a third slit 423 as shown in FIG. 6. The first, second and third slits 421, 422 and 423 are provided to allow the passage of the thread T that is inserted through the needle eye 91, so that the needle 9 can be pulled up smoothly without the thread T being caught. The second slit 422 is open to the second section 412 on the side in the x2 direction and extends in the z direction as viewed in the x direction. The third slit 423 is open to the third section 413 on the side in the x2 direction and connected to the first slit 421 and the second slit 422. The bottom portion of the first slit 421 is where the tip of the threading member 2 passes through. The first, second and third slits 421, 422 and 423 are connected together and extend substantially across the entire length of the needle receiving hole 41 in the z direction. When the needle 9 is pulled out of the needle receiving hole 41 after the thread T is passed through the needle eye 91, the thread T is be smoothly pulled out sequentially through the first, second and third slits 421, 422 and 423 that are connected together.

The movable member 43 has a pair of projected portions 431 flanking the third slit 423. When the movable member 43 is moved in the x1 direction, the projected portions 431 comes to push the needle 9 against the inner wall of the needle receiving hole 41 (in particular, the inner wall of the first section 411 and the second section 412).

According to the present embodiment, the first slit 421 includes a curved portion 421*a*. The curved portion 421*a* gently curves in the y direction (the third direction) from the z direction as viewed in the x direction. When the needle 9 is inserted into the needle receiving hole 41, the flat head of the needle 9 may be accidentally caught in the first slit 421. In such a case, the needle 9 cannot be properly oriented. According to the present invention, however, the first slit 421 of the present embodiment is provided with the curved portion 421*a*. The walls around the curved portion 421*a* serve to block the head of the needle 9 from sliding into the first slit 421. This ensures that the needle 9 is properly oriented. Note that the curved portion 421*a* shown in the figures is an example, and the shape of the curved portion 421*a* is not limited to the arc shape. Alternatively, the curved portion 421*a* may be a portion of the first slit 421 bent at a gentle angle relative to the z direction. The location of the curved portion 421*a* in the first slit 421 needs to be close to the third slit 423 (in the z2 direction).

The thread pressing mechanism 5 shown in FIGS. 2 to 4 and 11 to 13 is provided for holding the loop of the thread T inserted through the needle eye 91. The thread pressing mechanism 5 includes a pressure receiving part 51, a pressing member 52, a lever 53 and a biasing member 54.

The pressure receiving part 51 is disposed at an appropriate position on the housing 1 (at least in one of the first housing member 11 or the second housing member 12). According to the present embodiment, the pressure receiving part 51 is to be pressed by the pressing member 52 located below (in the z1 direction) the pressure receiving part 51 and has a surface facing in the z1 direction. Details of the pressure receiving part 51 will be described later.

The pressing member 52 can reciprocate vertically between the upper position (a first position) on or near the pressure receiving part 51 and the lower position (a second position) away from the pressure receiving part 51.

Figure 10:
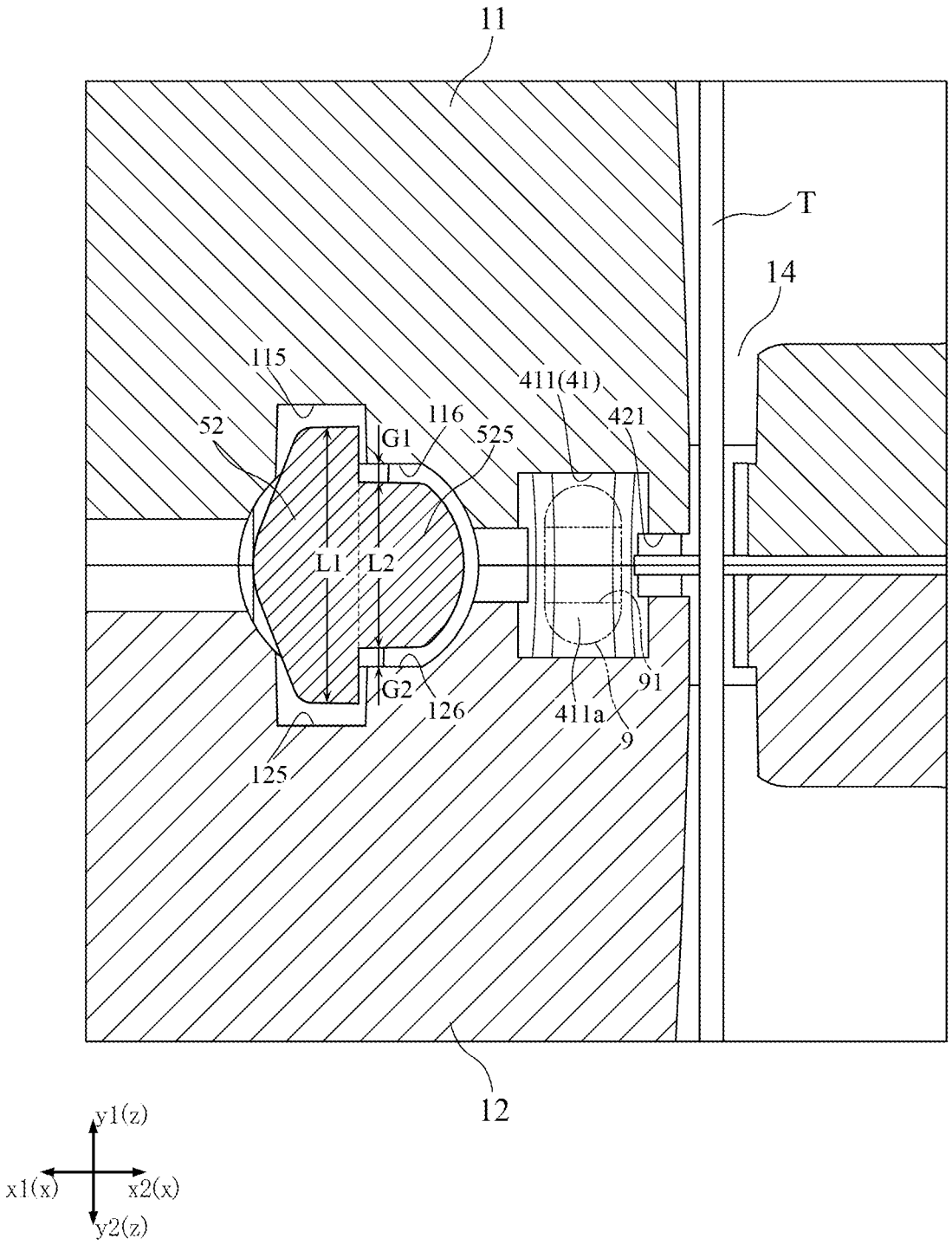
FIG. 10 is an enlarged fragmentary sectional view taken along line X-X of FIG. 3.

The pressing member 52 may include a pressure applying tip 521, a first sloped portion 522, a sliding shaft 523, an engaging portion 524 and a protrusion 525. As shown in FIGS. 3, 4, 7 and 8, the pressure applying tip 521 is formed at the tip of the pressing member 52 in the z2 direction and for contacting the loop of the thread T. As can be seen from FIGS. 8 and 9, the pressure applying tip 521 extends in the y direction. According to the present embodiment, the pressing member 52 is broader in the y direction at a portion offset in the z2 direction. This broader portion includes the pressure applying tip 521. As shown in FIG. 10, the broader portion of the pressing member 52 is guided along the channels 115 and 125 formed in the housing 1 (the first housing member 11 and the second housing member 12). This arrangement allows the pressing member 52 to reciprocate up and down.

Figure 7:
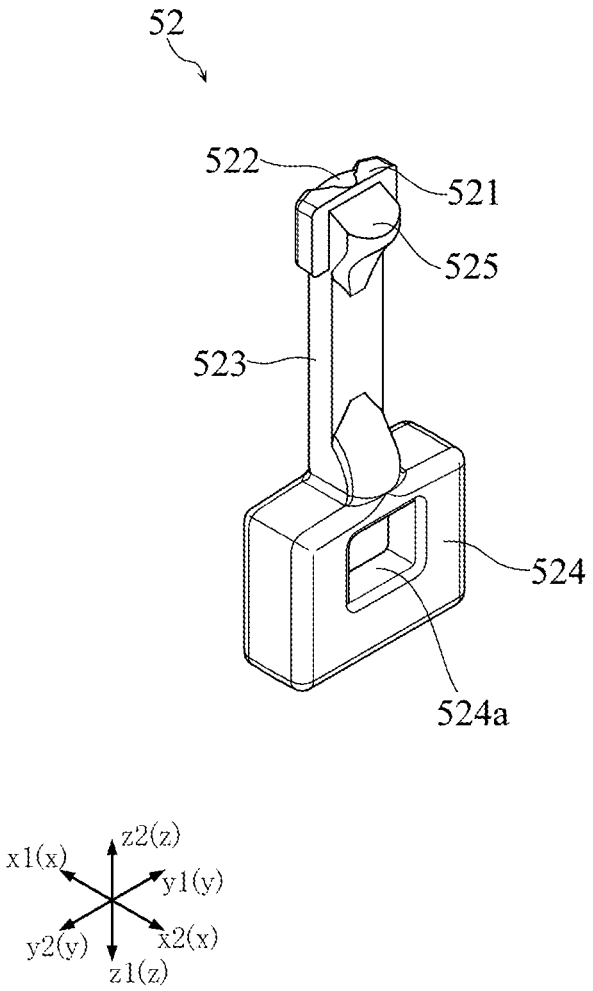
FIG. 7 is a perspective view showing a pressing member.

As shown in FIG. 7, the first sloped portion 522 is connected to the central portion of the pressure applying tip 521 in the y direction. The first sloped portion 522 is inclined in the z1 direction as it extends in the x1 direction.

The sliding shaft 523 is located in the middle of the pressing member 52 in the z direction and extends in the z direction. The engaging portion 524 is located at the end of the pressing member 52 in the z1 direction. The engaging portion 524 has an engaging hole 524*a* extending therethrough in the x direction for engagement with the lever 53.

The protrusion 525 protrudes in the x2 direction from the broader portion that is located closer in the pressing member 52 to the side in the z2 direction. The protrusion 525 has an upper surface sloped in the z1 direction toward the side in the x2 direction. As described later, the thread T to be sandwiched between the pressure applying tip 521 and the pressure receiving part 51 tends to sag by gravity, especially when the thread T is relatively thick. The protrusion 525 prevents the thread T from sagging. The protrusion 525 and the broader portion are accommodated in channels 116 and 126 formed in the housing 1 (the first housing member 11 and the second housing member 12).

The pressure applying tip 521 shown in FIGS. 9 and 10 is relatively long in the y direction (in a first dimension L1). According to the present embodiment, as shown in FIG. 10, the first dimension L1 of the pressure applying tip 521 (the broader portion of the pressing member 52) is greater than the total of the length of the protrusion 525 in the y direction (a second dimension L2) combined with the gaps G1 and G2 left in the channels 116 and 126.

The lever 53 has a first arm 531 and a second arm 532 and is pivotable on the shaft 74. The second arm 532 passes through the engaging hole 524*a* of the pressing member 52. The first arm 531 is in contact with the upper surface of the arm 371 of the actuating member 37.

The biasing member 54, which may be a compression coil spring, is disposed between the first arm 531 and the wall of the housing 1 located above (in the z2 direction) the first arm 531. The first arm 531 is normally urged in the z1 direction by the biasing member 54. This produces a torque urging the lever 53 to rotate counterclockwise in FIGS. 2 and 3, so that the pressing member 52 is urged upward (in the z2 direction) by the second arm 532. Thus, as shown in FIGS. 2 and 3, the pressing member 52 is placed in the upper position (the first position) when the operation lever 31 is not operated (the first state).

When the operation lever 31 of the actuator mechanism 3 is pressed downward, the arm 371 is raised in the z1 direction as shown in FIGS. 11 and 12. Consequently, the first arm 531 is pushed upward by compressing the biasing member 54 against the biasing force. As a result, the lever 53 is rotated clockwise to move the pressing member 52 to the lower position (the second position). When the pressing member 52 is in the lower position (the second position), the biasing member 54 is compressed against its biasing force.

Figure 5:
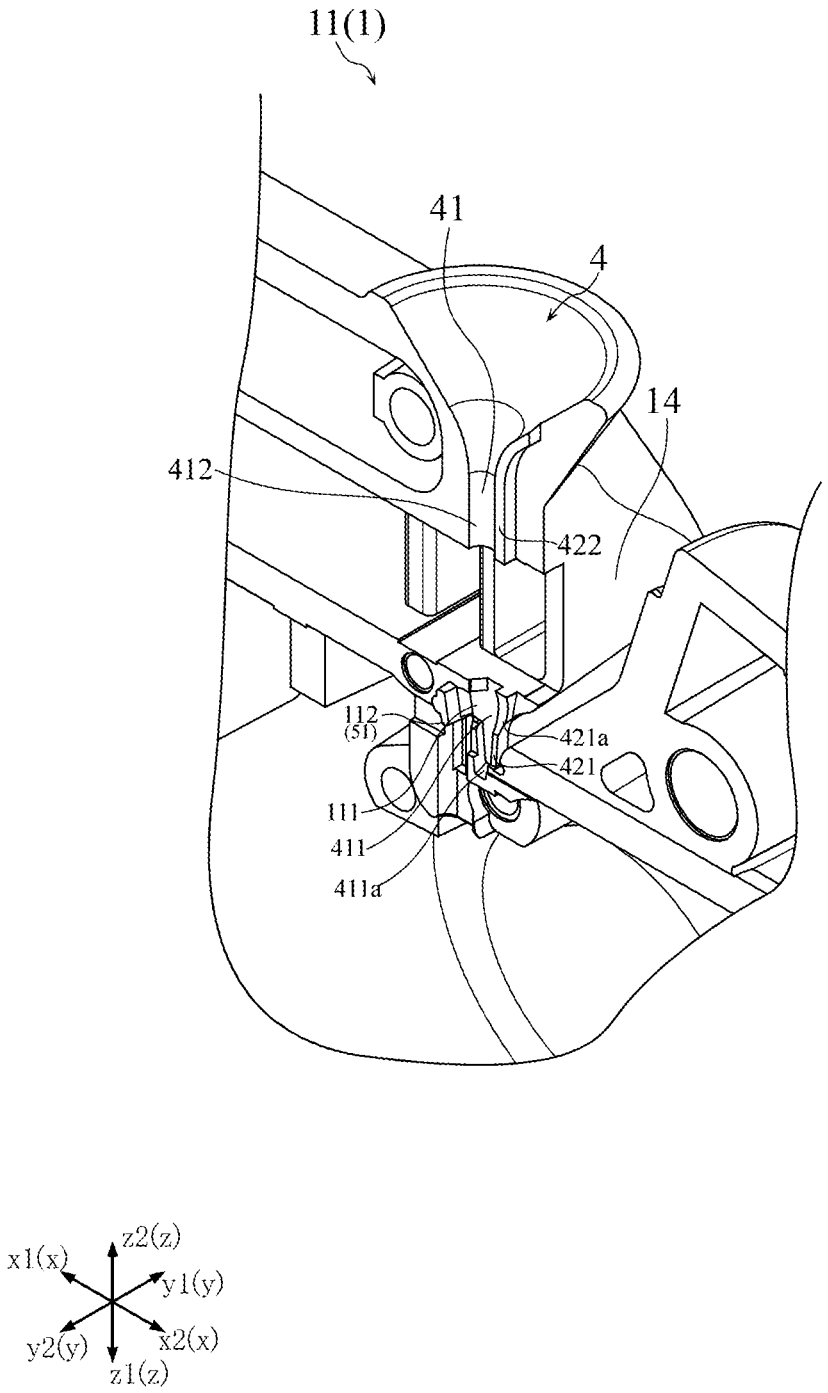
FIG. 5 is a fragmentary perspective view showing a first housing member.
Figure 8:
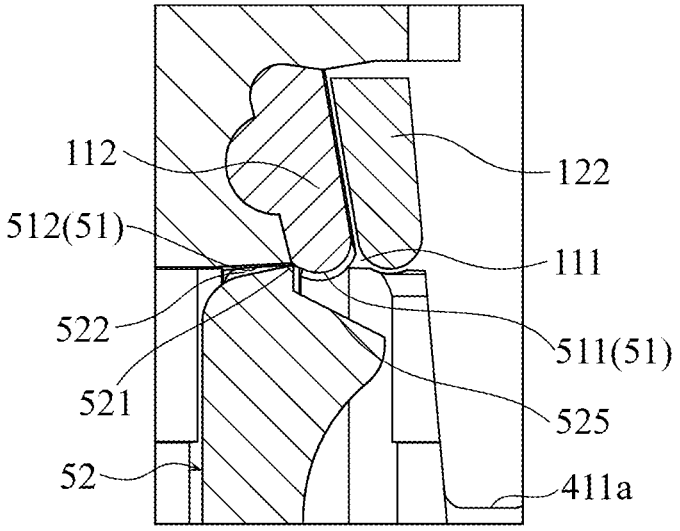
FIG. 8 is an enlarged view showing a portion of FIG. 3.
Figure 8:
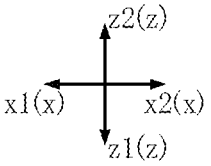

With reference to FIGS. 5, 8 and 9, the following describes details of the pressure receiving part 51, as well as the interaction between the pressure receiving part 51 and the pressing member 52 (the pressure applying tip 521).

According to the present embodiment, the pressure receiving part 51 is disposed to face the pressure applying tip 521 of the pressing member 52 as viewed in the x direction. The pressure receiving part 51 has a first portion 511 and a second portion 512. The first portion 511 is formed in the first housing member 11. The first housing member 11 has a first abutting surface 111 facing in the y2 direction and a first protruding wall 112 protruding from the first abutting surface 111 in the y2 direction. The second housing member 12 has a second protruding wall 122. The second protruding wall 122 is adjacent to the first protruding wall 112 in the x2 direction and protrudes in the y1 direction. The second protruding wall 122 has an end face facing in the y1 direction, and this end face serves as a second abutting surface 121 that is disposed in surface contact with the first abutting surface 111 of the first housing member 11.

FIG. 9 shows the relative position of the first protruding wall 112 and the pressing member 52 as viewed from the side in the x2 direction toward the side in the x1 direction. In FIG. 9, the second protruding wall 122 of the second housing member 12 is closer toward the front, and the first protruding wall 112 of the first housing member 11 is farther in the back. The first protruding wall 112 is disposed close enough to the pressure applying tip 521 for sandwiching the thread T between the lower end of the first protruding wall 112 and the pressure applying tip 521. According to the present embodiment, the lower portion (in the z1 direction) of the first protruding wall 112 serves as the first portion 511. That is, the first portion 511 is a portion of the pressure receiving part 51 and included in the first protruding wall 112.

The lower end (in the z1 direction) of the second protruding wall 122 is located above (in the z2 direction) the lower end (the first portion 511) of the first protruding wall 112. As shown in FIG. 8, in addition, the second protruding wall 122 is offset in the x2 direction from the first protruding wall 112. That is, the second protruding wall 122 is located farther from the pressure applying tip 521 of the pressing member 52 than the first protruding wall 112 is. This configuration ensures that the thread T is not caught between the second protruding wall 122 and the pressure applying tip 521. The second protruding wall 122 is not a part of the pressure receiving part 51.

According to the present embodiment, as shown in FIG. 8, the second portion 512 is a surface adjacent to the first protruding wall 112 in the x1 direction and facing in the z1 direction. That is, the second portion 512 is located near the first protruding wall 112 and faces the pressure applying tip 521. This configuration allows the second portion 512 and the pressure applying tip 521 to sandwich the thread T between them. In one example, the second portion 512 is included partly in the first housing member 11 and partly in the second housing member 12.

The manner how the needle threader A1 is used and how it works will be described.

First, as shown in FIG. 2, a user sets a needle 9 in the needle holding part 4 and places thread T over the recess 14. Then, the user presses the operation lever 31 down against the resilient force of the resilient member 36. In response, the actuating member 37 rotates as described above, and the movable member 43 moves in the x1 direction as the actuating member 37 rotates. As a result, the needle 9 is pushed against the inner wall of the needle receiving hole 41 (the first section 411 and the second section 412), ensuring that the axis of the needle 9 is positioned in front of the threading member 2.

As the user presses the operation lever 31 further down, the various parts of the actuator mechanism 3 work to move the threading member 2 in the x1 direction as shown in FIGS. 11 and 12. In this state where the operation lever 31 is operated (the second state), the threading member 2 (the thread-engaging portion 21) is moved to the advanced position through the needle eye 91 in the x1 direction. When the threading member 2 (the thread-engaging portion 21) enters the needle eye 91, the thread T is pushed into the needle eye 91 to form a loop having two portions passing the needle eye 91. The pressure receiving part 51 overlaps with the loop of the thread T as viewed in the z direction.

In response to the operation of the operation lever 31, the thread pressing mechanism 5 works as described above. When the operation lever 31 is operated (the second state) as shown in FIGS. 11 and 12, the various parts of the thread pressing mechanism 5 cooperate to move the pressing member 52 to the lower position (the second position). Since the thread pressing mechanism 5 is operatively associated with the operation lever 31 (the actuator mechanism 3), the pressing member 52 is retracted to the lower position (the second position) away from the traveling path of the threading member 2 when the threading member 2 moves to the advanced position for pushing the thread T. This prevents the pressing member 52 from interfering with the travel of the threading member 2.

Subsequently, when the user releases the operation lever 31, the operation lever 31 is moved upward by the resilient force of the resilient member 36, and the operation state is switched to the unoperated state (the first state). This causes the threading member 2 to move in the x2 direction to the original position (the retracted position) away from the needle holding part 4 in the x2 direction.

When the operation lever 31 is switched to the unoperated state (the first state), the thread pressing mechanism 5 is actuated by rotation of the actuating member 37 to push the pressing member 52 upward (in the z2 direction) as shown in FIG. 13. The pressing member 52 (the pressure applying tip 521) thus moved upward presses the loop of the thread T, which is located directly under the pressure receiving part 51, against the pressure receiving part 51. In this state, the pressing member 52 is urged by the resilient force of the biasing member 54 to the upper position (the first position) through the cooperation of the various parts of the thread pressing mechanism 5 described above. The loop TL of the thread T is therefore firmly sandwiched between the pressure receiving part 51 and the pressing member 52 (the pressure applying tip 521). FIG. 14 is a schematic view similar to FIG. 9 and shows the state where the loop TL is held between the pressure receiving part 51 and the pressing member 52 (the pressure applying tip 521).

Then, the user pulls the needle 9 upward (in the z2 direction) to remove the needle 9 from the needle holding part 4. In this state, the loop TL of thread T passed through the needle eye 91 is still sandwiched between the pressure receiving part 51 and the pressing member 52. Consequently, as the needle 9 is raised higher, the thread end TE of the loop TL is pulled toward the needle eye 91 as shown in FIG. 15. Eventually, the thread end TE is pulled out from the needle eye 91, so that the single thread T runs through the needle eye 91 as shown in FIG. 16. Then, the user grips the head of the needle 9 (around the needle eye 91) with his/her fingers and gently pulls the head of the needle 9 together with the thread T passed through the needle eye 91. In this way, the thread T is disengaged from the thread pressing mechanism 5 (from the position between the pressure receiving part 51 and the pressing member 52).

The needle threader A1 is provided with the thread pressing mechanism 5. The thread pressing mechanism 5 includes the pressure receiving part 51, the pressing member 52 and the biasing member 54. In response to the operation of the operation lever 31, the pressing member 52 presses the loop TL (the thread T passed through the needle eye 91) against the pressure receiving part 51. This configuration enables the thread end TE of the loop TL to be pulled out of the needle eye 91 to have the single thread T run straight through the needle eye 91, by pulling the needle 9 out from the needle holding part 4 after operating the operation lever 31. In other words, unlike the conventual needle threader, the threading operation is completed without requiring the user to go through the step of pulling the thread end TE of the loop of thread T out of the needle eye 91 after pulling the needle 9 out from the needle threader A1. In addition, the needle threader A1 prevents the loop TL from accidentally slipping out of the needle eye 91 by holding holds the loop TL with the thread pressing mechanism 5.

The pressing member 52 has the pressure applying tip 521 for contacting the loop TL. The pressure applying tip 521 extends in the y direction, which is perpendicular to the z direction along the longitudinal direction of the needle 9 held by the needle holding part 4 and also to the x direction in which the threading member 2 moves back and force. As will be understood from FIGS. 13 and 14, this configuration is effective for firmly holding two portions of the loop TL of the thread T.

The pressure receiving part 51 is disposed to face the pressure applying tip 521 as viewed in the x direction in which the threading member 2 moves back and force (see FIG. 14). This positional relation enables the pressure applying tip 521, which extends in the y direction, to reliably hold the loop TL of the thread T.

The pressing member 52 has the first sloped portion 522 (see FIGS. 7 and 8). The first sloped portion 522 is connected to the central portion of the pressure applying tip 521 in the y direction and is inclined in the z1 direction toward the side in the x1 direction. With the first sloped portion 522, the distance in the x direction along which the loop TL is pressed between the pressing member 52 and the pressure receiving part 51 is relatively short. The thread pressing mechanism 5 (the pressure receiving part 51 and the pressing member 52) can therefore press the loop TL of a thread T of a variety of thickness with an appropriate pressure, so that the usability of the needle threader A1 is improved.

The first housing member 11 has the first protruding wall 112 that protrudes in the y2 direction from the first abutting surface 111 joined to the second abutting surface 121 of the second housing member 12. The pressure receiving part 51 (the first portion 511) is included in the first protruding wall 112. As will be understood from FIG. 14, this configuration allows the loop TL to be sandwiched at a location away from the first abutting surface 111 and the second abutting surface 121 where the first housing member 11 and the second housing member 12 are joined. This eliminates undesirable possibility of catching the thread T in the gap between the first housing member 11 and the second housing member 12 when the thread T is pulled out.

The needle threader of the present disclosure is not limited to the embodiment described above. Various changes may be made to the needle threader without departing from the scope of the claims.

The invention claimed is:

1. A needle threader comprising:

a needle holding part for holding a needle having a needle eye;

a threading member reciprocally movable between a retracted position separated from the needle holding part and an advanced position for inserting a loop of thread through the needle eye by the threading member entering the needle eye;

an actuator mechanism including an operation element and being configured to move the threading member to the retracted position when the operation element is in a first state to not operate the operation element and move to the advanced position when the operation element is in a second state to operate the operation element; and a thread pressing mechanism for pressing the loop of thread that is inserted through the needle eye by the threading member, wherein the thread pressing mechanism includes a pressure receiving part, a pressing member that is reciprocally movable between a first position on or near the pressure receiving part and a second position separated from the pressure receiving part, and a biasing member that urges the pressing member toward the first position, and when the operation element is in the second state, the pressing member is moved to the second position, and when the operation element is switched from the second state to the first state, the pressing member is capable of pressing the loop of thread against the pressure receiving part.

2. The needle threader according to claim 1, wherein the needle holding part includes a needle receiving hole having a needle supporting bottom surface, the needle receiving hole extending in a first direction that is along a longitudinal direction of the needle held by the needle holding part, the needle supporting bottom surface being offset in a first sense of the first direction, the threading member moves to the advanced position by entering the needle eye in a first sense of a second direction perpendicular to the first direction, the pressing member includes a pressure applying tip for contacting the loop of thread, and the pressure applying tip extends in a third direction perpendicular to the first direction and the second direction.

3. The needle threader according to claim 2, wherein the pressure receiving part is disposed to face the pressure applying tip as viewed in the second direction.

4. The needle threader according to claim 3, wherein the pressing member has a first sloped portion that is connected to a center of the pressure applying tip in the third direction and inclined in the first sense of the first direction as it extends in the first sense of the second direction.

5. The needle threader according to claim 3, further comprising a first housing member and a second housing member supporting the actuator mechanism and being respectively offset in a first sense and a second sense of the third direction, wherein the first housing member has a first abutting surface facing in the second sense of the third direction, and the second housing member has a second abutting surface facing in the first sense of the third direction and in contact with the first abutting surface, the first housing member includes a first protruding wall that protrudes from the first abutting surface in the second sense of the third direction, and the first protruding wall includes the pressure receiving part.

6. The needle threader according to claim 2, wherein the needle receiving hole includes a first section offset in the first sense of the first direction, a second section separated from the first section in a second sense of the first direction, and a third section located between the first section and the first section, the needle holding part includes a movable member for pushing the needle in the first sense of the second direction, the third section is composed of the movable member, the needle holding part has a first slit, a second slit and a third slit that are respectively opened in the first section, the second section and the third section toward a side of each section in a second sense of the second direction, the second slit extends in the first direction as viewed in the second direction, the third slit extends in the first direction as viewed in the second direction and is connected to the first slit and the second slit, and the first slit includes a curved portion that is gently curved in the third direction from the first direction as viewed in the second direction.

7. A needle threading mechanism that includes: a needle receiving hole having a needle supporting bottom surface, the needle receiving hole extending in a first direction that is along a longitudinal direction of a needle held in the needle receiving hole, the needle supporting bottom surface being offset in a first sense of the first direction; and a threading member that can enter a needle eye of the needle held in the needle receiving hole, the needle threading mechanism being capable of inserting a loop of thread through the needle eye by the threading member entering the needle eye, the needle threading mechanism comprising:

a guide mechanism for guiding the needle into the needle receiving hole, wherein the needle receiving hole is formed with a slit that extends substantially across an entire length of the needle receiving hole in the first direction and that includes a curved portion gently curved from the first direction; and a thread pressing mechanism including a pressure receiving part and a pressing member that is reciprocally movable between a first position on or near the pressure receiving part and a second position separated from the pressure receiving part, wherein the pressing member is moved to the second position when the threading member enters the needle eye, and the pressing member is capable of pressing the loop of thread inserted through the needle eye against the pressure receiving part when the threading member retracts to a position away from the needle eye.

* * * * *